US005106323A

United States Patent [19]

Gerhard

[11] Patent Number: 5,106,323

[45] Date of Patent: Apr. 21, 1992

[54] ELECTRICAL WIRE CONNECTOR FOR MULTI-CONDUCTOR HEATING CABLE

[75] Inventor: Hans Gerhard, Brittnau, Switzerland

[73] Assignee: Domotec AG., Aarburg, Switzerland

[21] Appl. No.: 599,505

[22] Filed: Oct. 18, 1990

[30] Foreign Application Priority Data

Nov. 8, 1989 [CH] Switzerland ..... 4025/89

[51] Int. Cl.[5] ..... H01R 4/24

[52] U.S. Cl. ..... 439/410; 439/394

[58] Field of Search ..... 439/409-419, 439/394, 395, 425, 426, 427, 607-610, 578, 581, 394

[56] References Cited

U.S. PATENT DOCUMENTS

| | | | |
|---|---|---|---|
| 1,977,677 | 10/1934 | Hill | 439/410 |
| 3,411,129 | 11/1968 | Peters | 439/409 |
| 3,976,351 | 8/1976 | Hopfe | 439/409 |
| 4,469,391 | 9/1984 | Rich | 439/394 |

FOREIGN PATENT DOCUMENTS

| | | | |
|---|---|---|---|
| 2136638 | 9/1984 | United Kingdom | 439/409 |

*Primary Examiner*—David L. Pirlot

*Attorney, Agent, or Firm*—Brady, O'Boyle & Gates

[57] ABSTRACT

The electrical wire connector for a multi-conductor, shielded heating cable (3) with a power cable (7) comprises a heating cable connecting section (1) and a power cable connecting section (5) joined permanently together. The heating cable (3) is attached in the heating cable connecting section (1) by means of a lever-like crimping connection (33) and its inner conductor is conductively connected through its surrounding insulation (16) with the electrical contacts (37*a*, 37*b*) of the heating cable connecting section (1). In a preferred embodiment, several heating cable and power cable connecting sections can be joined together. The assembly of the heating cable (3) in the heating cable connecting section (1) is simple and safe in operation. This assembly can be performed even by unskilled personnel lacking knowledge in the field of electric power engineering, in particular by heating and sanitary installers, without loss of safety and functional ability.

22 Claims, 3 Drawing Sheets

Fig.1
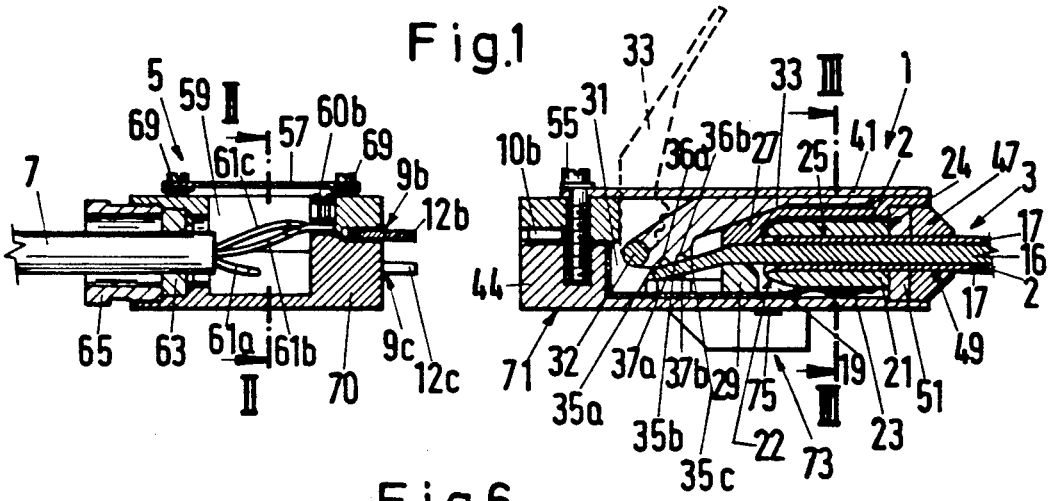
Fig.6
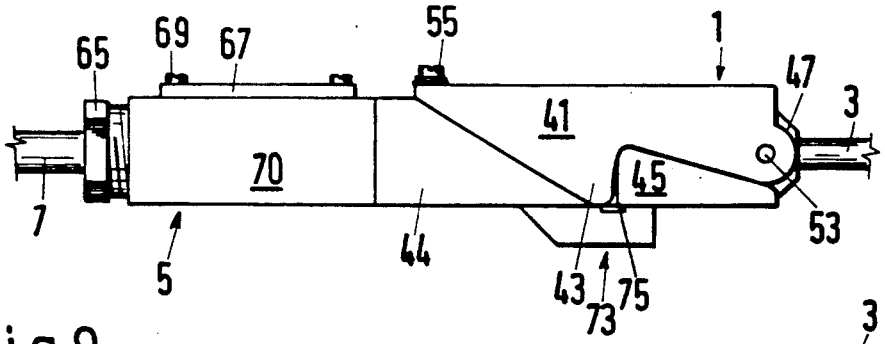
Fig.9
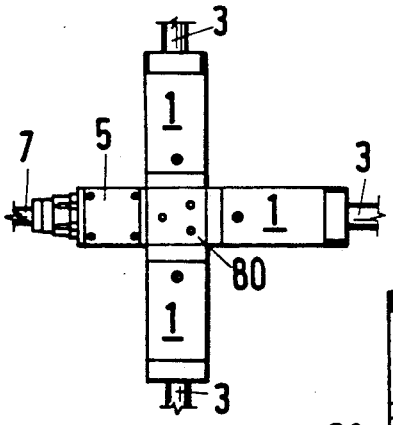
Fig.8
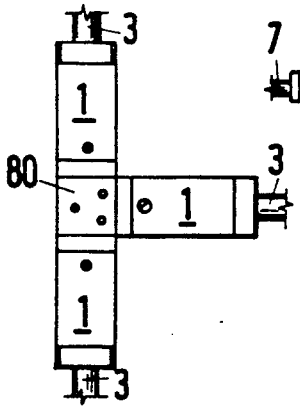
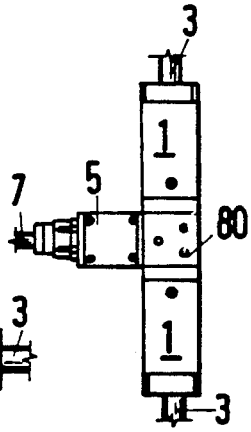
Fig.11
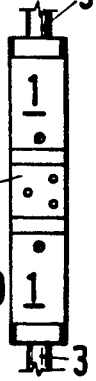
Fig.10

Fig.2
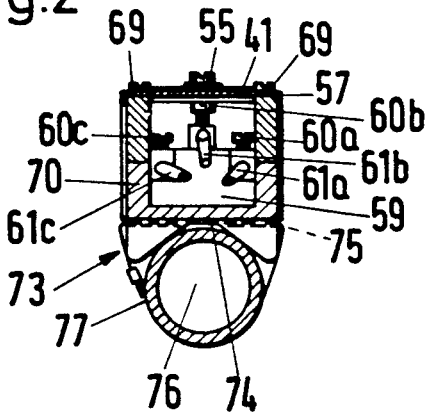
Fig.3
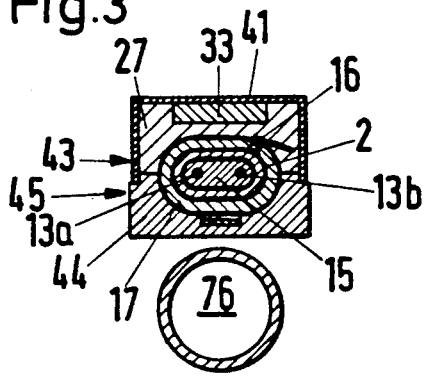
Fig.4
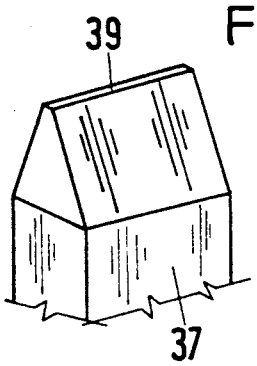
Fig.7
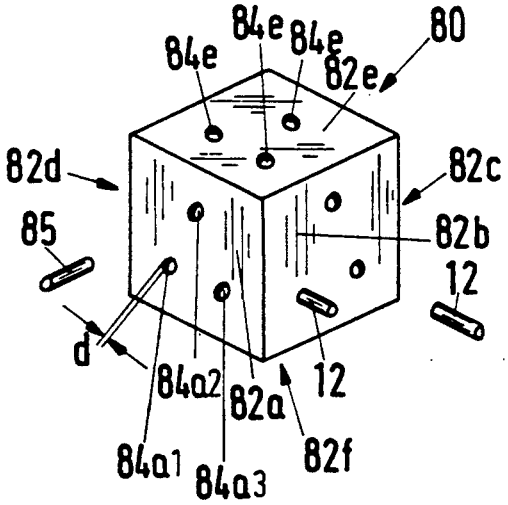
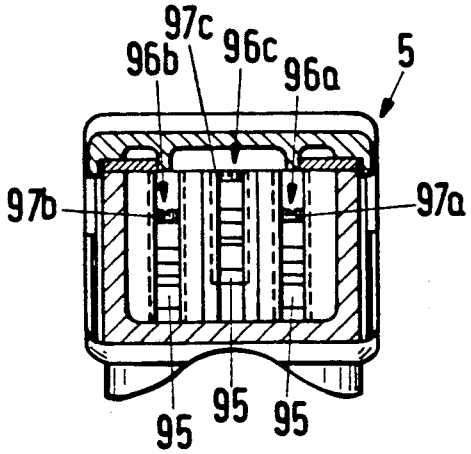
Fig.15

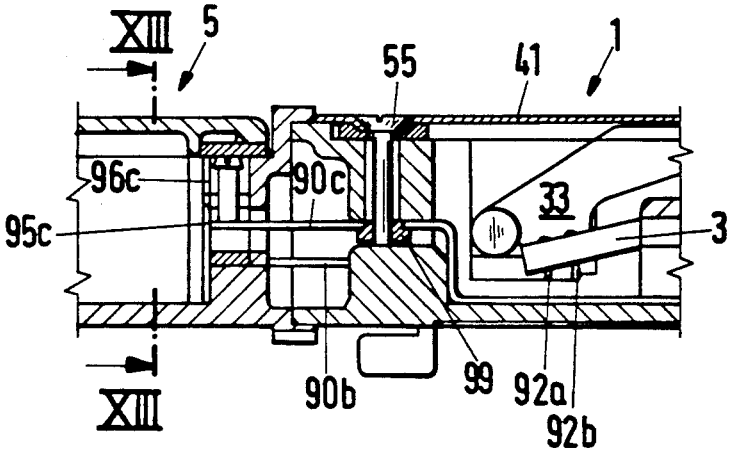
Fig.12
Fig.13
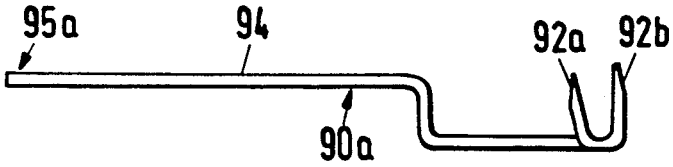
Fig.14
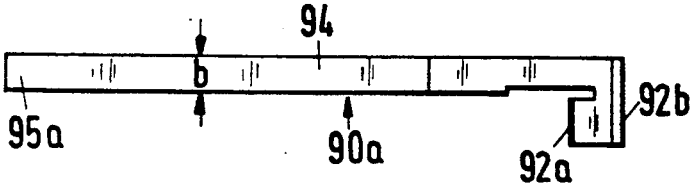
Fig.5
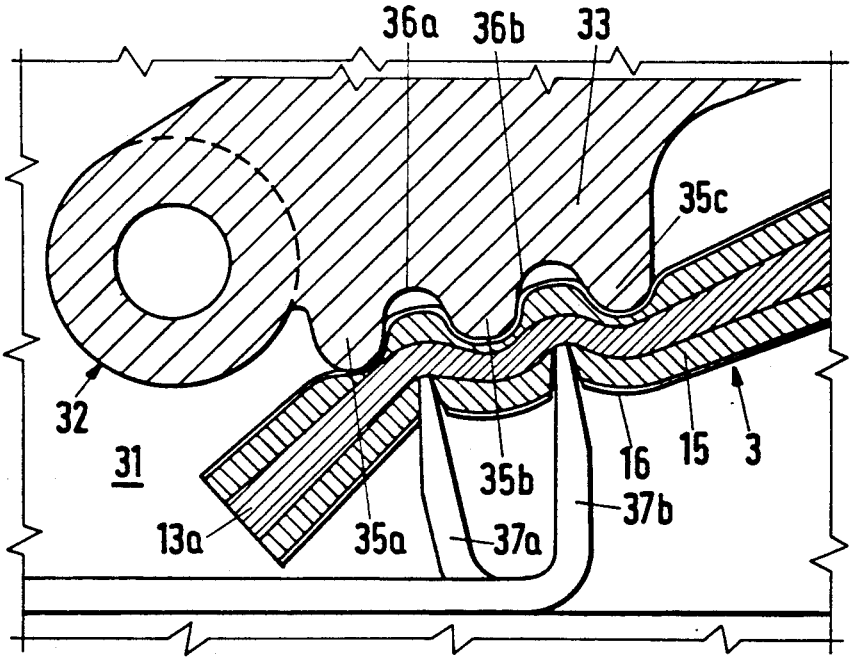

ELECTRICAL WIRE CONNECTOR FOR MULTI-CONDUCTOR HEATING CABLE

The invention relates to an electrical wire conductor for a multi-conductor heating cable.

Heating cables are utilized, in particular, for the heating of water pipes which carry hot water so that hot water is immediately available when the hot-water faucet is turned on. Heretofore, in order to install the heating cable in a heating cable connector, the latter was disassembled into its components—screw joint, slotted gasket, central housing, plug part, and metal screw connection—and subsequently the heating cable was installed in several working steps. For connecting the heating cable with a current supply cable, a connector set, consisting of a connecting socket for the power cable and the heating cable connection, was joined by threading. For connecting heating cables with each other, a connecting set was utilized, and for the connection of several heating cables with one another, a T-branching set was used.

German Patent 727,578 discloses a wire connector for unshielded cables of an on-board current supply in airplanes and vehicles. The cables are retained on their stripped wires by an eccentric lever which latter is secured against release due to vibrations by using a further lever. The wire connectors can only be utilized by skilled personnel; also, the tension relief of the cables leaves much to be desired.

EP-A 0 189 234 describes another wire connector for unshielded multi-conductor cables. In this arrangement, several wires, stripped prior to connection, are retained by a serrated eccentric fashioned as a lever by means of friction (force-derived connection) or by a shape-mating connection, by bending the respective wire. Electrical contacting takes place between two electrical contacts, one of which is urged against the stripped wire. The lever is secured against reopening by means of a clamping element. Here again, the wire connectors can only be utilized by skilled personnel. Furthermore, the tension relief of the cable leaves much to be desired.

The invention, as described, creates an electrical wire connector making it possible to install multi-conductor, shielded heating cables in a simple, fast, and functionally safe manner even under adverse environmental conditions.

Examples of the wire connector according to this invention will be described in greater detail below with reference to the drawings wherein:

FIG. 1 is a sectional view of a wire connector prior to the permanent connection, effected during production, of the heating cable connecting section and the power cable connecting section, FIG. 2 is a section through the wire connector along line II—II in FIG. 1, FIG. 3 is a section through the wire connector along line III—III in FIG. 1, FIG. 4 is a perspective view of a cutting tool head of a contact chisel of the heating cable connecting section, FIG. 5 is a longitudinal section through the heating cable, pressed onto the contact chisels with the crimping bar of the wire connector, on a scale enlarged as compared with FIG. 1, FIG. 6 is a lateral view of the wire connector, FIG. 7 is a perspective view of a connecting element for the connection of wire cable connecting sections and/or power cable connecting sections, on an enlarged scale, FIG. 8 shows a wire connector consisting of three heating cable connecting sections and one connecting element, FIG. 9 shows a wire connector consisting of three heating cable connecting sections, a power cable connecting section, and a connecting element, FIG. 10 shows a wire connector consisting of two heating cable connecting sections and one connecting element, FIG. 11 is a wire connector consisting of two heating cable connecting sections, one power cable connecting section, and one connecting element, FIG. 12 is a longitudinal section through a modification of the wire connector, FIG. 13 is a lateral view of a phase conductor of the modification shown in FIG. 12, FIG. 14 is a top view of the phase conductor illustrated in FIG. 13, and FIG. 15 is a section through the wire connector shown in FIG. 12 along line XIII—XIII in FIG. 12.

The electrical wire connector illustrated in FIG. 1 comprises a heating cable connecting section 1 for the connection of a heating cable 3 provided with a braided shield 2, and a power cable connecting section 5 for the connection of a mains cable 7. Respectively three electrically conductive sockets 9*a*–9*c* and 10*a*–10*c* with a resilient jacket are provided in the heating cable connecting section 1 and in the power cable connecting section 5 for the electrical connection of the heating cable connecting section 1 with the power cable connecting section 5 for the two phases as well as the ground wire. In the completely assembled condition as illustrated in FIG. 6, respectively one metallic pin 12*a*, 12*b* and 12*c* is inserted in these sockets for the electrical connection between the respective sockets 9*a* and 10*a*, 9*b* and 10*b*, and 9*c* and 10*c*. In the not as yet entirely assembled condition as illustrated in FIG. 1, the pins 12*a*, 12*b* and 12*c* are seated in the socket 9*a*, 9*b* and 9*c* for providing a clearer illustration. This arrangement, as will be explained below, will never actually occur and has been chosen solely for a better illustration of the individual components. Although the heating cable connecting section 1 and the power cable connecting section 5 are still separated from each other during the manufacturing process, there is no heating cable 3 connected thereto and no power cable connection 5 at that time.

The heating cable 3 has two inner conductors 13*a* and 13*b* shown in FIG. 3 which are embedded in an electrically conductive polymer 15, as utilized, for example, in EP-A 0 133 748. The conductive polymer 15 is surrounded by an electrically insulating jacket 16 enveloped by the braided shield 2. The braided shield 2 is surrounded, for mechanical protection, by an insulating protective sheath 17. With the application of an electric voltage between the two inner conductors 13*a* and 13*b*, the conductive polymer 15 is heated, due to the current flowing therethrough, to a temperature dependent on the type of polymer.

The heating cable connecting section 1 has an outwardly open housing cavity 19 at its end facing away from the end face with the sockets 10*a* through 10*c*; a clamping sleeve 21 with a rounded end face and a linear end face 22 and 24 is inserted in this cavity. In the lower sidewall of the housing cavity 19, an undulated contact lug 23 of spring bronze is arranged which is connected to the socket 10*b* and presses against the clamping sleeve 21 and the braided shield 2 inverted over this sleeve. In the opening 25 of the clamping sleeve 21, the heating cable 3 is provided. Between the end face 22, a portion of the outer wall of the clamping sleeve 21, and the respective adjoining wall of the housing cavity 19, the braided shield 2 is clamped in place.

The upper boundary half of the housing cavity 19 is constituted in FIG. 1 by a dish 27 of an elastic, electrically insulating material. The bottom boundary half of the housing cavity 19 is delimited with respect to the end face of the clamping sleeve 21 by a metallic locking bolt 29 and with respect to the longitudinal side of the clamping sleeve by an inner side, carrying the contact lug 23, of the housing 44 of the heating cable connecting section 1, this housing consisting of an electrically insulating material. As described below, the elastic dish 27 urges the clamping sleeve 21, the braided shield 2, and the contact lug 23 against one another, and retains the heating cable 3 with tension resistance in the heating cable connecting section 1.

The polymer 15 and the insulating jacket 16, connecting the inner conductors 13*a* and 13*b*, project past the dish 27 and the locking bolt 29 as a boundary for the housing cavity 19 and extend into a second cavity 31 until abutment against a joint 32 for supporting a crimping lever 33 made of an electrically insulating material. The crimping lever 33 has three raised portions 35*a*, 35*b* and 35*c* separated from one another by two grooves 36*a* and 36*b*, as illustrated in FIG. 5 in an enlarged fragmentary longitudinal section through the housing 44 with heating cable 3 and closed crimping lever 33. Two pairs of contact chisel blades 37*a* and 37*b*. as well as 38*a* and 38*b* are arranged below the grooves 36*a* and 36*b*; only the contact cutter blade pair 37*a* and 37*b* is illustrated in FIG. 1 as well as FIG. 5. The contact cutter blade pair 37*a* and 37*b* is electrically conductively connected to the socket 9*c* and the contact cutter blade pair 38*a* and 38*b* is connected in an electrically conductive fashion with the socket 9*a*. The pair of contact cutter blades 38*a* and 38*b* is designed analogously to the pair of contact cutter blades 37*a* and 37*b*.

The cutter head of the contact chisel blade 37*a* illustrated in FIG. 4 (the cutter heads of the contact chisels 37*b*, 38*a* and 38*b* being of identical design) is fashioned as a prism, approximately lying perpendicularly to the inner conductors 13*a* and 13*b*, with a flat-designed top prism face 39 with an approximate length of two-thirds of the mutual distance of the inner conductors 13*a* and 13*b*, having the configuration of a screwdriver blade. The position is selected so that the inner conductor 13*a* and 13*b* of typical heating cables 3 lies in the center of the prism face 39. Positional tolerances of the inner conductors 13*a* and 13*b*, which can amount to up to one millimeter, can be compensated for by the relatively large length of the prism face 39. The raised portions 35*a*, 35*b* and 35*c* of the crimping lever 33 bend the protruding end of the heating cable 3 toward the prism heads of the contact cutter blades 37*a*, 37*b*, 38*a* and 38*b*, and urge them through the jacket 16 and the polymer 15 against the inner conductors 13*a* and 13*b*. On account of the offset arrangement of the raised portions 35*a*, 35*b*, 35*c* with respect to the cutter heads of the contact chisel blades 37*a* and 37*b*, as well as 38*a* and 38*b*, the cutter heads exert slight friction on the surface of the inner conductors 13*a* and 13*b* and thereby remove any possibly present layer of poor electrical conductivity, dirt and/or oxide layer. Furthermore, elastic deformation of the inner conductors 13*a* and 13*b* occurs whereby the latter are pressed elastically against the cutter heads for reducing the electrical contact resistance. The prism face 39 prevents cutting of the chisel heads into the inner conductors 13*a* and 13*b* contact surface permitting a considerably higher current flow than contact knife blades.

The crimping lever 33 is covered by a closing lid 41 illustrated in FIG. 6. The closing lid 41 engages with respectively one pawl 43 laterally over the housing 44 of the heating cable connecting section 1 into a pawl counterpart 45; the lid is articulated to an end piece 47 (joint 53) provided with an internal bore 49, illustrated in FIGS. 1 and 6. The heating cable 3 is disposed in the internal bore 49. An elastic ring 51 is arranged around the heating cable 3 between the end piece 47 and the side 24 facing away from the clamping sleeve end face 22. The contours of ring 51 are dimensioned so that when the end piece 47 presses against the clamping sleeve end face 24 the heating cable 3 is clamped in place and the housing cavity 19 is sealed against splash water.

The sealing lid 41 and the crimping lever 33 interlock with dual lever action, i.e. the unsupported side of the crimping lever 33 lies in the proximity of the joint 53 of the sealing lid 41. Thereby, the raised portions 35*a*, 35*b* and 35*c* of the crimping lever 33 can be urged with great force against the contact chisels 37*a*, 37*b*, 38*a* and 38*b*. The closing lid 41, as shown in FIG. 6, is secured against unauthorized opening by means of a screw 55.

The mains cable connecting section 5 shown in FIGS. 1 and 6 has a cavity 59 closed with a lid 57 in the upward direction. As illustrated in FIG. 2, the sockets 9*a*, 9*b* and 9*c* (FIG. 1 showing only the socket 9*b*) are located on one side of the cavity 59 with their cable mounting screws 60*a*, 60*b* and 60*c* for the wires 61*a*, 61*b* and 61*c* of the mains cable 7. An elastic ring 63 lies in the side of the cavity 59 oppositely thereto; this ring is seated on the power cable 7 and can be elastically deformed by means of an end screw joint 65 in such a way that the ring acts as tension relief for the mains cable 7 and as a splash water seal for the cable with respect to the cavity 59. The lid 57 is attached to the housing 70 of the power cable connecting section 5 by means of four screws 69. The lid 57 is removed for power cable installation.

Respectively one of the sockets 10*a*, 10*b* and 10*c* of the heating cable connecting section 1 is electrically connected by means of respectively one of the pins 12*a*, 12*b* and 12*c* to respectively one of the sockets 9*a*, 9*b* and 9*c* of the power cable connecting section 5, as described above and as illustrated in FIG. 1 in the not as yet assembled condition. The heating cable connecting section 1 and the power cable connecting section 5 are manufactured as two separate parts which are permanently joined while still in production for safety reasons, for example by means of cementing, ultrasonic welding or high-frequency welding.

The heating cable connecting section 1 has on its underside 71 a mounting 73 with a channel 74, as illustrated in FIGS. 1, 2, 3 and 6. The mounting 73 is provided directly below the underside 71 with a bore 75 approximately perpendicular to the channel axis. The channel 74 is fashioned so that the mounting 73, as shown in FIGS. 2 and 3, is seated on a tubular conduit 76 and is attached to the latter by means of a band-shaped mounting element, for example a cable tie 77.

In order to mount the heating cable 3 in the heating cable connecting section 1 of the wire connector, the cable is cut off approximately perpendicularly to its longitudinal direction. The sealing lid 41 and the crimping lever 33 are opened (dashed-line position in FIG. 1). The end piece 47 with the sealing lid 41, the elastic ring 51, and the clamping sleeve 21 can now be removed from the housing 44 and are pushed in the above sequence over the cut-off heating cable 3. The protective jacket 17 of the heating cable 3 is removed from the heating cable end up to about 23 mm+5 mm, −0 mm, so that the braided up to about shield 2 is bare. The uncovered braided shield 2 is radially expanded, the clamping sleeve 21 is pushed against the bare braided shield 2 in the direction toward the heating cable end, and the widened braided shield 2 is inverted away from the heating cable end over the outside of the clamping sleeve 21. Subsequently, the heating cable end is pushed through the housing cavity 19, through the funnel-shaped form of the dish 27 and of the locking bolt 29 up to abutment against the joint 32 of the crimping lever 33 into the housing 44. The crimping lever 33 is urged downwards at its end in opposition to the joint 32, the elastic ring 51 is pushed with the connecting piece 47 against the clamping sleeve 21, and the sealing lid 41 is urged downwards until it locks with its pawl 43 into the pawl counterpart 45.

By the downward urging of the crimping lever 33, its raised portions 35*a*, 35*b* and 35*c* press the end of the heating cable 3, freed of the protective sheath 17 and the braided shield 2, against the contact chisels 37*a*, 37*b*, 38*a* and 38*b* which penetrate through the jacket 16 and the polymer 15 to the inner conductors 13*a* and 13*b*. By the downward pressure of the sealing lid 41, the clamping sleeve 21 is pressed with the braided shield 2 lying on its outside against the dish 27, the locking bolt 29, and the contact lug 23; additionally, the elastic ring 51 is deformed by pressure between the clamping sleeve 21 and the end piece 47 in such a way that the housing cavity 19 is sealed toward the outside safe from splash water. The sealing lid 41 acts on the crimping lever 33 as a double lever arm whereby the contact chisel blades 37*a*, 37*b*, 38*a* and 38*b* are urged vigorously against the inner conductors 13*a* and 13*b*, and the latter are elastically deformed for the establishment of a good electrical connection.

For connecting the power cable 7 to the power connecting section 5 of the wire connector, its mounting lid 67 is opened, the end screw joint 65 and the ring 63 are pushed over the cable end, the wires 61*a*, 61*b* and 61*c* are laid bare at the power cable end and are stripped, and are attached in the sockets 9*a*, 9*b* and 9*c* with the cable mounting screws 60*a*, 60*b* and 60*c*. Then the end screw joint 65 is threaded into the housing 70 whereby the power cable 7 is held by clamping action in the housing 70 by means of the ring 63. The mounting lid 67 is then again attached with the four screws 69.

Instead of manufacturing the connecting element between the heating and power cable connecting sections 1 and 5 of merely three pins 12*a*, 12*b* and 12*c*, it is possible to utilize a cube 80, shown in perspective view in FIG. 7. On each cube face 82*a* to 82*f*, the cube has respectively three connecting sockets 84*a*1, 84*a*2, 84*a*3, 84*b*1, 84*b*2, . . . 84*f*2, 84*f*3, the first index denoting the face and the second index designating the respective socket. All sockets 84 with index 1 are electrically connected with one another, likewise the sockets having the index 2 and 3, respectively. All of the sockets 84*a*1 to 84*f*3 are set back by a distance d from the surface of the respective cube face 82*a* to 82*f*. The sockets 84 that are not needed are sealed with insulating pins 85, one of which is shown in FIG. 7 prior to assembly, and one being shown pressed into the socket 84*a*3.

Several composition possibilities of heating cable and power cable connecting sections 1 and 5 by means of a cube 80 are shown in FIGS. 8 through 11, FIG. 8 showing a combination of three heating cable connecting sections 1 joined with a cube 80 as the connecting element; FIG. 9 showing a combination of three heating cable connecting sections 1 and a power cable connecting section 5; FIG. 10 showing a combination of two heating cable connecting sections 1; and FIG. 11 showing a combination of two heating cable connecting sections 1 and a power cable connecting section 5. The connection of heating cable and/or power cable connecting sections 1 and 5, respectively, to the cube 80 can be composed as desired. The sockets 10*a*, 10*b* and 10*c*, as well as 9*a*, 9*b* and 9*c* of the heating cable connecting section 1 and of the power cable connecting section 5 are connected with the respective sockets 84 of the cube 80 via respectively one of the pins 12 which is placed into one of the sockets 84 and 10 or 9 to be connected together. After the mounting of the respective heating cable or power cable connecting sections 1 and 5 with the cube 80, the mutually abutting end faces are permanently joined together for safety reasons, for example by cementing, ultrasonic welding or high-frequency welding. The sockets 84 of the cube 80 that are not needed are firmly sealed with the pins 85.

In place of a single bore 75 in the mounting 73, it is also possible to use two bores (not shown) which extend obliquely with respect to each other, respectively one cable tie (not illustrated) being passed through these bores, in order to mount the wire connector.

Instead of the crimping lever 33, it is also possible to utilize a plate (not shown) with raised portions 35*a*, 35*b*, 35*c* which is pressed only by the sealing lid 41 against the inserted heating cable end. The contact pressure of the contact chisels 37*a*, 37*b*, 38*a* and 38*b* producible on the inner conductors 13*a* and 13*b* is, however, significantly lower on account of the lack of double lever action between the crimping lever 33 and the sealing lid 41; also, the plate, as contrasted to the crimping lever 33, is no longer held in the housing 44 in a nondetachable fashion.

Instead of securing the sealing lid 41 against unauthorized opening with the screw 55, it is also possible to mount a detent (not shown) at the sealing lid 41, this detent engaging into the housing 44.

Instead of effecting the connection of the phases and of the ground wire, as described above, between the heating cable and power cable connecting sections 1 and 5 by means of the sockets 9*a* to 9*c*, 10*a* to 10*c*, and by means of the pins 12*a* to 12*c*, the connection can also be provided, as in case of a version of the wire connector shown in FIG. 12, with one-piece conductors 90*a* to 90*c*. One of the two phase conductors 90*a* and 90*b* is illustrated in FIG. 13 in a lateral view and in FIG. 14 in a top view.

The phase conductor 90*a* is a member punched from a sheet-metal strip, the bevel-cut contact chisels 92*a* and 92*b* of which are bent away at the sheet-metal strip end. The residual part of the sheet metal is fashioned as a contact lug 94, the strip width b of which was chosen to be so large that its free end serves as a contact support 95*a* in the electrical connecting terminal 96*a* of the power cable connecting section 5. The current conductor of the power cable 7 to be inserted in the connecting terminal 96*a* is then clamped with the connecting terminal screw 97*a* against the contact support 95*a*. A phase conductor 90*b* for the other phase is designed in analogy to the phase conductor 90*a*.

A ground wire 90*c* electrically connected with the braided shield 2 in the heating cable connecting section 1 is designed analogously to the phase conductors 90*a* and 90*b*, but has a threaded insert 99 as illustrated in FIG. 12, this insert being connected in conductive fashion via the screw 55 with the metallic sealing lid 41. Thereby the sealing lid 41 is grounded.

On account of the modular structure of the wire connector of heating cable connecting section 1, power cable connecting section 5, and cube 80, which are firmly connected with one another during manufacture, a plurality of wire connectors can be produced in adaptation to the respectively intended usage.

Since the mounting of the heating cable 3 in the heating cable connecting section 1 takes place by means of lever-operated crimping connections in a clamp-like motion process, this mounting can be performed in a rapid, simple, and secure fashion.

The connections of the power cable 7 and also of the heating cable 3 in the power cable connecting section 5 and, respectively, in the heating cable connecting section 1, are sealed so that they are safe from splash water. Access to parts which carry voltage during operation cannot be accomplished without a tool.

Due to the simple and safe assembly of the heating cable 3 in the heating cable connecting section 1, this can also be accomplished by personnel unskilled in the area of electric power engineering, especially by heating and sanitary installers, without loss of safety and functional efficiency.

I claim:

1. An electrical wire connector with a housing having a first connecting section (1) for connecting a heating cable (3) having a braided shielding (2) and multiple insulated cable lines (13*a*, 13*b*), and a second connecting section (5) for connecting a multi-conductor power cable (7) having multiple insulated power lines (61*a*, 61*b*, 61*c*), comprising at least one contact chisel (37*a*, 37*b*, 38*a*, 38*b*; 92*a*, 92*b*) per cable line (13*a*, 13*b*) of the heating cable (3) to be connected, situated in said first connecting section (1), a lever-operated crimping means (32, 33, 35, 37, 41) pivotally mounted on said housing, said lever-operated crimping means (32, 33, 35, 37, 41) having electrical connecting means (21, 23) for the braided shielding (2), said lever-operated crimping means (32, 33, 35, 37, 41) having fixing means (21, 47, 51) for fixedly mounting the heating cable (3) in place in the first connecting section (1) so that it is sealed against splash water and secured against tension, said lever-operated crimping means (32, 33, 35, 37, 41) having a crimping lever (33) lying opposite to said contact chisels (37*a*, 37*b*, 38*a*, 38*b*; 92*a*, 92*b*) and pivotally supported at said first connecting section (1), said crimping lever (33) having at least one raised portion (35*a*, 35*b*, 35*c*) for each of said contact chisels (37*a*, 37*b*, 38*a*, 38*b*; 92*a*, 92*b*) lying opposite to the chisels (37*a*, 37*b*, 38*a*, 38*b*; 92*a*, 92*b*) respectively, said raised portion (35*a*, 35*b*, 35*c*) arranged in such a way, that, when the end region part of the heating cable (3) freed of the braided shielding (2) is inserted between said chisels and said raised portions, said crimping lever (33) is pivoted into the first connecting section (1), the contact chisels (37*a*, 37*b*, 38*a*, 38*b*; 92*a*, 92*b*) penetrate through the insulation of the cable lines (13*a*, 13*b*) of the heating cable (3) into electrical contact with said cable lines (13*a*, 13*b*).

2. An electrical wire connector according to claim 1, in which the head of each of said contact chisels (37*a*, 37*b*, 38*b*; 92*a*, 92*b*) is fashioned in the manner of a screwdriver blade with a contact surface (39).

3. An electrical wire connector according to claim 1, in which said contact chisels (37*a*, 37*b*, 38*a*, 38*b*; 92*a*, 92*b*) are arranged to be offset with respect to said raised portions (35*a*, 35*b*, 35*c*).

4. An electrical wire connector according to claim 1, in which said first connecting section (1) having a first chamber (31) with a first opening passing through the wall of said first connecting section (1), said crimping means (32, 33, 35, 37, 41) having a pivotally lever-like sealing lid (41) for closing said first opening, said lever-like sealing lid (41) having a first bearing (53), said crimping lever (33) having a second bearing (32), said first and said second bearing (53, 32) are arranged oppositely for adding the effective lever arm length of said pivotally lever-like sealing lid (41) and said crimping lever (33), whereby the raised portions (35*a*, 35*b*, 35*c*) urge said chisels (37*a*, 37*b*, 38*a*, 38*b*; 92*a*, 92*b*) with great force against the insulation of the cable lines (13*a*, 13*b*) of the heating cable (3).

5. An electrical wire connector according to claim 1, wherein said first connecting section (1) having a chamber (31) with a first and a second opening through the wall of said first connecting section (1), said fixing means (21, 47, 51) having a clamping sleeve (21), and a forcing piece (47), said clamping sleeve (21) having an outer jacket and a bore (25) adapted to the profile of said heating cable (3), the end region part of said heating cable (3) stripped off to said braided shielding (2) being passable through said bore (25) of said clamping sleeve (21), said braided shielding (2) after passing through said bore (25) being expanded and pulled back over said outer jacket, said forcing piece (47) being pressable by said crimping lever (33) against said clamping sleeve (21) that said braided shielding (2) is pulled back over, and said outer jacket being pressed against the wall of said second opening in the first connecting section (1).

6. An electrical wire connector according to claim 1, in which said first connecting section (1) and said second connecting section (5) are two separate parts welded together.

7. An electrical wire connector according to claim 1, including phase conductors formed integrally from a sheet-metal piece having one end fashioned as at least one of said contact chisels (92a, 92b) and the other end fashioned as a contact lug (94), electrical connecting terminals (96a, 96b, 96c) positioned in said second connecting section (5) for connecting the power lines (61a, 61b, 61c) of said multi-conductor power cable (7), and each of said contact lugs (94) serving as a contact support (95a, 95b, 95c) in said electrical connecting terminals (96a, 96b, 96c) for each one of said power lines of the power cable (7) to be clamped in each of said electrical connecting terminals (96a, 96b, 96c).

8. An electrical wire connector with a housing having a first connecting section (1) for connecting a heating cable (3) having a braided shielding (2) and multiple insulated cable lines (13a, 13b), and a second connecting section (5) for connecting a multi-conductor power cable (7) having multiple insulated power lines (61a, 61b, 61c), comprising at least one contact chisel (37a, 37b, 38a, 38b; 92a, 92b) per cable line (13a, 13b) of the heating cable (3) to be connected, situated in said first connecting section (1), a lever-operated crimping means (32, 33, 35, 37, 41) pivotally mounted on said housing, said lever-operated crimping means (32, 33, 35, 37, 41) having at least one raised portion (35a, 35b, 35c) for each of said contact chisels (37a, 37b, 38a, 38b; 92a, 92b) lying opposite to the chisels (37a, 37b, 38a, 38b; 92a, 92b) respectively, said raised portion (35a, 35b, 35c) arranged in such a way, that, when the end region part of the heating cable (3) freed of the braided shielding (2) is inserted between said chisels and said raised portions, said crimping lever (33) is pivoted into the first connecting section (1), the contact chisels (37a, 37b, 38a, 38b; 92a, 92b) penetrate through the insulation of the cable lines (13a, 13b) of the heating cable (3) into electrical contact with said cable lines (13a, 13b), said lever-operated crimping means (32, 33, 35, 37, 41) having fixing means (21, 47, 51) for fixedly mounting said heating cable (3) in place in the first connecting section (1) so that it is sealed against splash water and secured against tension, said fixing means (21, 47, 51) having a clamping sleeve (21), and a forcing piece (47), said first connecting section (1) having a chamber (31) with an opening through the wall of the first connecting section (1), said clamping sleeve (21) having a jacket and a bore (25) adapted to the profile of said heating cable (3), the end region part of said heating cable (3) stripped off to said braided shielding (2) being passable through said bore (25) of said clamping sleeve (21), said braided shielding (2) after passing through said bore (25) being expanded and pulled back over said outer jacket, said forcing piece (47) being pressable by said crimping lever (33) against said clamping sleeve (21) that said braided shielding (2) is pulled back over, and said outer jacket being pressed against the wall of said second opening in the first connecting section (1).

9. An electrical wire connector according to claim 8, including a contact lug (23) positioned on the wall of said opening and being electrically connectable with said braided shielding (2) or with said clamping sleeve (21).

10. An electrical wire connector according to claim 8, in which said lever-operated crimping means (32, 33, 35, 37, 41) having a crimping lever (33) lying opposite to said contact chisels (37a, 37b, 38a, 38b; 92a, 92b), said crimping lever (33) carrying said raised portion (35a, 35b, 35c).

11. An electrical wire connector according to claim 8, in which said chamber (31) of said first connecting section (1) having a further opening through the wall of said first connecting section (1), said lever-operated crimping means (32, 33, 35, 37, 41) having a pivotally lever-like sealing lid (41) closing said further opening, said lever-like sealing lid (41) having a first bearing (53), said crimping lever (33) having a second bearing (32), said first and said second bearings (53, 32) are arranged oppositely for adding the effective lever arm length of said pivotally lever-like sealing lid (41) and said crimping lever (33), whereby the raised portions (35a, 35b, 35c) urge said chisels (37a, 37b, 38a, 38b; 92a, 92b) with great force against the insulation of the cable lines (13a, 13b) of the heating cable (3).

12. An electrical wire connector according to claim 8, in which said forcing piece (47) is pivotally connected to said crimping lever (33), said crimping lever (33) having a pawl (43), a pawl counterpart (45) engageable into said pawl (43) of said crimping lever (33) and arranged at an outer wall part of said first connecting section (1).

13. An electrical wire connector according to claim 8, in which each contact chisel having a head, and the head of each of said contact chisels (37a, 37b, 38a, 38b; 92a, 92b) is fashioned in the manner of a screwdriver blade with a contact surface (39).

14. An electrical wire connector according claim 8, in which said contact chisels (37a, 37b, 38a, 38b; 92a, 92b) are arranged to be offset with respect to said raised portions (35a, 35b, 35c).

15. An electrical wire connector according to claim 8, in which said first connecting section (1) and said second connecting section (5) are two separate parts welded together.

16. An electrical wire connector according to claim 8, including phase conductors formed integrally from a sheet-metal piece having one end fashioned as at least one of said contact chisels (92a, 92b) and the other end fashioned as a contact lug (94), electrical connecting terminals (96a, 96b, 96c) positioned in said second connecting section (5) for connecting the power lines (61a, 61b, 61c) of said multi-conductor power cable (7), and each of said contact lugs (94) serving as a contact support (95a, 95b, 95c) in said electrical connecting terminals (96a, 96b, 96c) for each one of said power liens of the power cable (7) to be clamped in each of said electrical connecting terminals (96a, 96b, 96c).

17. An electrical wire connector with a housing having a first connecting section (1) for connecting a heating cable (3) having a braided shielding (2) and multiple insulated cables lines (13*a*, 13*b*), and a second connecting section (5) for connecting a multi-conductor power cable (7) having multiple insulated power lines (61*a*, 61*b*, 61*c*), comprising a lever-operated crimping means (32, 33, 35, 37, 41) pivotally mounted on said housing, said lever-operated crimping means (32, 33, 35, 37, 41) having first electrical connecting means for the braided shielding (2), second electrical connecting means for connecting said cable lines (13*a*, 13*b*) of said heating cable (3), said lever-operated crimping means (32, 33, 35, 37, 41) having fixing means (21, 47, 51) for fixedly mounting the heating cable (3) in place in the first connecting section (1) so that it is sealed against splash water and secured against tension, a mounting (73) formed on the outer wall of said housing, said mounting having a channel (74) with a channel axis and at least one bore (75) extending approximately perpendicular to said channel axis through said mounting (73), a strip-shaped fastening element (77) passing through said bore (75), a tubular conduit (76), and said electrical wire connecting means being attachable to said tubular conduit (76) by means of said strip-shaped fastening element (77).

18. An electrical wire connector according to claim 17, in which said second electrical connecting means having at least one contact chisel (37*a*, 37*b*, 38*a*, 38*b*; 92*a*, 92*b*) per cable line (13*a*, 13*b*) of the heating cable (3) to be connected, situated in said first connecting section (1), said lever-operated crimping means (32, 33, 35, 37, 41) having a crimping lever (33) lying opposite to said contact chisels (37*a*, 37*b*, 38*a*, 38*b*; 92*a*, 92*b*) and pivotally supported on said first connecting section (1).

said crimping lever (33) having at least one raised portion (35*a*, 35*b*, 35*c*) for each of said contact chisels (37*a*, 37*b*, 38*a*, 38*b*; 92*a*, 92*b*) lying opposite to the chisels (37*a*, 37*b*, 38*a*, 38*b*; 92*a*, 92*b*) respectively, said raised portion (35*a*, 35*b*, 35*c*) arranged in such a way, that, when the end region of the heating cable (3) freed of the braided shielding (2) is inserted between said chisels and said raised portions, said crimping lever (33) is pivoted into the first connecting section (1), the contact chisels (37*a*, 37*b*, 38*a*, 38*b*; 92*a*, 92*b*) penetrate through the insulation of the cable lines (13*a*, 13*b*) of the heating cable (3) into electrical contact with said cable lines (13*a*, 13*b*).

19. An electrical wire connector according to claim 17, in which said first connection section (1) having a chamber (31) with an opening through the wall of said first connecting section (1), said lever-operated crimping means (32, 33, 35, 37, 41) having a pivotally lever-like sealing lid (41) for closing said opening, said lever-like sealing lid (41) having a first bearing (53), said crimping lever (33) having a second bearing (32), said first and said second bearings (53, 32) are arranged oppositely for adding the effective lever arm length of said pivotally lever-like sealing lid (41) and said crimping lever (33), and raised portions (35*a*, 35*b*, 35*c*) on said crimping lever positioned to urge said chisels (37*a*, 37*b*, 38*a*, 38*b*; 92*a*, 92*b*) with great force against the insulation of the cable lines (13*a*, 13*b*) of the heating cable (3).

20. An electrical wire connector according to claim 17, in which said first connecting section (1) having a chamber (31) with an opening through the wall of said first connecting section (1), said fixing means (21, 47, 51) of said lever-operated crimping means (32, 33, 35, 37, 41) having a clamping sleeve (21), and a forcing piece (47), said clamping sleeve (21) having an outer jacket and a bore (25) adapted to the profile of said heating cable (3), the end region part of said heating cable (3) stripped off to said braided shielding (2) passing through said bore (25) of said clamping sleeve (21), said braided shielding (2) after passing through said bore (25) being expanded and pulled back over said outer jacket, said forcing piece (47) being pressable by said crimping lever (33) against said clamping sleeve (21) that said braided shielding (2) is pulled back over, and said outer jacket being pressed against the wall of said opening in said first connecting section (1).

21. An electrical wire connector according to claim 17, in which said first connecting section (1) and said second connecting section (5) are two separate parts welded together.

22. An electrical wire connector according to claim 17, including phase conductors formed integrally from a sheet-metal piece having one end fashioned as at least one of said contact chisels (92*a*, 92*b*) and the other end fashioned as a contact lug (94), electrical connecting terminals (96*a*, 96*b*, 96*c*) positioned in said second connecting section (5) for connecting the power lines (61*a*, 61*b*, 61*c*) of said multi-conductor power cable (7), and each of said contact lugs (94) serving as a contact support (95*a*, 95*b*, 95*c*) in said electrical connecting terminals (96*a*, 96*b*, 96*c*) for each one of said power lines of the power cable (7) to be clamped in each of said electrical connecting terminals (96*a*, 96*b*, 96*c*).

* * * * *